US006806627B2

(12) United States Patent
Manning

(10) Patent No.: US 6,806,627 B2
(45) Date of Patent: Oct. 19, 2004

(54) PROBE STABILIZED ARC DISCHARGE LAMP

(75) Inventor: William Lawrence Manning, Walpole, MA (US)

(73) Assignee: PerkinElmer, Inc., Salem, MA (US)

( * ) Notice: Subject to any disclaimer, the term of this patent is extended or adjusted under 35 U.S.C. 154(b) by 38 days.

(21) Appl. No.: 10/120,975

(22) Filed: Apr. 11, 2002

(65) Prior Publication Data

US 2003/0193281 A1 Oct. 16, 2003

(51) Int. Cl.[7] ..... H01J 1/02
(52) U.S. Cl. ..... 313/113; 313/567; 313/595
(58) Field of Search ..... 313/113, 567, 313/581, 601, 595, 303; 361/117, 120

(56) References Cited

U.S. PATENT DOCUMENTS

| | | | | |
|---|---|---|---|---|
| 3,559,546 A | | 2/1971 | McKee et al. | |
| 3,731,133 A | | 5/1973 | McRae et al. | |
| 3,934,166 A | | 1/1976 | Stuart | |
| 4,179,037 A | | 12/1979 | Chan et al. | |
| 4,599,540 A | | 7/1986 | Roberts | |
| 4,633,128 A | | 12/1986 | Roberts et al. | |
| 4,658,179 A | | 4/1987 | Roberts | |
| 4,940,922 A | * | 7/1990 | Schuda et al. | 315/246 |
| 5,128,596 A | | 7/1992 | Shimazu et al. | |
| 5,299,279 A | * | 3/1994 | Roberts | 392/421 |
| 5,399,931 A | | 3/1995 | Roberts | |
| 5,721,465 A | | 2/1998 | Roberts | |
| 6,236,147 B1 | | 5/2001 | Capobianco | |
| 2002/0167255 A1 | | 11/2002 | Roberts et al. | |

* cited by examiner

*Primary Examiner*—Ashok Patel
(74) *Attorney, Agent, or Firm*—Iandiorio & Teska

(57) ABSTRACT

A probe stabilized arc discharge lamp including a base portion, a window spaced from the base portion, a side wall interconnecting the base portion with the window. The side wall, the base portion, and the window define a chamber. A first electrode is disposed vertically in the chamber and extends outwardly through the base portion. A second electrode is also disposed vertically in the chamber and is spaced from the first electrode. The second electrode extends outwardly through the base portion. The first and second electrodes define an arc gap. There is also at least one trigger probe extending to or proximate to the arc gap for triggering an arc in the arc gap. Also, a reflector is disposed about the arc gap for directing radiation generated by the arc out the window. A sparker may also be provided.

82 Claims, 25 Drawing Sheets

PROBE STABILIZED ARC DISCHARGE LAMP

FIELD OF THE INVENTION

This invention relates to a probe stabilized arc discharge lamp usually operated in a pulsed mode.

BACKGROUND OF THE INVENTION

Arc discharge lamps are used for spectroscopy, as sources of light with a response over a broad spectrum, and for many other uses. Most arc discharge lamps have several components in common: an arc gap defined by two opposing electrodes, one of which is a cathode, another being an anode, disposed in a gas (e.g., Xenon) filled chamber. A reflector is typically disposed about the arc gap and light emitted at the arc gap is directed by the reflector out a window.

There are two basic types of arc discharge lamps: those designed to operate in a continuous mode and those designed to be operated in a pulsed mode. Typically, arc discharge lamps designed to be operated in a continuous mode cannot generally be operated in a pulsed mode because of, inter alia, the differences in the internal pressures generated, the lack of a trigger probe in continuously operated lamps, the increased cathode and anode sputtering which occurs in the pulse mode and the criticality of cathode and anode alignment in pulsed mode lamps.

Therefore, continuous mode lamps, if operated in a pulsed mode, would suffer from a short useful life and a less than desirable output. There are also two basic continuous mode lamp designs: those with horizontally disposed cathodes and anodes, and those with vertically disposed cathodes and anodes. By horizontally disposed electrodes, we mean electrodes disposed across the light path from the arc gap to the reflector and out through the window. By vertically disposed electrodes, we mean electrodes extending in the direction of the light path. The vertically disposed cathode and anode design advantageously has an improved lambertian distribution because the arc gap can be set at the focal point of the reflector and there is a minimum of structure disposed in the light path between the arc gap and the window.

Today, however, all successful pulsed mode arc discharge lamp designs have included only horizontally disposed electrodes. But, because of the benefits of vertically disposed electrodes in continuous mode arc discharge lamps, as discussed above, those skilled in the art have long desired a pulsed mode arc discharge lamp with vertically disposed electrodes. Due to the required physical differences between pulsed mode and continuous mode arc discharge lamps, however, the design of a continuous mode arc discharge lamp with vertically disposed electrodes has not translated into a successful pulsed mode arc discharge lamp design with vertically disposed electrodes.

Disclosed herein is a probe stabilized short arc discharge lamp designed to be operated in a pulse mode and advantageously having vertically disposed electrodes made possible, inter alia, by unique cathode and anode configurations, a uniquely designed trigger probe electrode, a preionization device called a sparker, monolithically constructed ceramic housing with a reflector integrally disposed thereon, a novel cathode jig for co-axially aligning and correctly distancing the cathode with respect to the anode, and a novel trigger probe jig for orienting the probe tip with respect to the arc gap. And, preferably, all of the electrode connections extend through the base of the lamp.

SUMMARY OF THE INVENTION

It is therefore an object of this invention to provide a high output, long life arc discharge lamp designed to be operated in a pulsed mode.

It is a further object of this invention to provide such an arc discharge lamp with vertically disposed electrodes.

It is a further object of this invention to provide such an arc discharge lamp with integrated optical components.

It is a further object of this invention to provide such an arc discharge lamp which can be operated at a high pressure.

It is a further object of this invention to provide a more efficient arc discharge lamp.

It is a further object of this invention to provide such an arc discharge lamp with improved lambertian distribution.

It is a further object of this invention to provide an arc discharge lamp with increased stability.

It is a further object of this invention to provide an arc discharge lamp which requires less power to operate for a given output.

It is a further object of this invention to provide such an arc discharge lamp which lasts longer.

It is a further object of this invention to provide such an arc discharge lamp which does not exhibit excessive sputtering.

It is a further object of this invention to provide such an arc discharge lamp which does not suffer from breakdown potentials.

It is a further object of this invention to provide an arc discharge lamp which is single ended: that is, all the electrical connections extend from the base portion of the lamp.

It is a further object of this invention to provide such an arc discharge lamp which is relatively easy and inexpensive to manufacture.

It is a further object of this invention to provide such an arc discharge lamp which can be repeatedly assembled in an exacting configuration.

It is a further object of this invention to provide a cathode jig for co-axially aligning and correctly distancing the cathode with respect to the anode.

It is a further object of this invention to provide a trigger probe jig which correctly orients the trigger probe tip with respect to the arc gap.

In this invention, the advantages of vertically disposed electrodes are realized in a pulsed mode arc discharge lamp by a uniquely configured anode and cathode, the presence of a trigger probe, a preionization device call a sparker, a monolithically constructed base and side wall lamp housing portion typically made of ceramic material, an integral reflector constructed directly on the ceramic housing, the use of a novel cathode jig which assists manufacturing personnel in co-axially aligning and correctly distancing the cathode with respect to the anode, and a novel trigger probe jig which assists manufacturing personnel in correctly orienting the probe tip with respect to the arc gap.

This invention features a probe stabilized arc discharge lamp. Typically, the lamp includes a monolithic base portion and side wall portion defining a concave surface, a window spaced from the base portion and sealed with respect to the side wall portion defining a chamber, a gas in the chamber, and a reflector disposed on or integral with the concave surface. A first electrode is usually centrally disposed in the base portion and has a distal end which extends outwardly from the base portion. In the preferred embodiment, the first electrode includes an anode support and an anode vertically supported by the anode support. Also in the preferred embodiment, there is a second electrode also having a distal end which extends outwardly from the base portion. The second electrode preferably includes a cathode support extending vertically upward through the side wall portion, a cathode support arm extending horizontally inward from the cathode support, and a cathode extending vertically downward from the cathode support arm to a location spaced from the anode to define an arc gap at the focal point of the reflector. Finally, a third electrode is preferably included which also has a distal end extending outwardly from the base portion. The third electrode extends vertically upward through the side wall portion and has a reduced circumference region or probe support pin proximate the side wall portion. The third electrode further includes a trigger probe extending from the reduced circumference region to or proximate to the arc gap for triggering an arc in the arc gap between the anode and the electrode.

In one example, the base portion and the side wall portion are made of a ceramic material, the anode support includes a distal seat for receiving the anode, the anode support is made of Kovar, the anode has a flat distal surface with no chamfers, the cathode support is made of Kovar, the cathode support arm is made of molybdenum, the cathode is made of a material including tungsten and the cathode has a pointed and tapered distal (e.g., 60° tapered) end.

The cathode support may have a recess on a distal end thereof for receiving one end of the cathode support arm and the cathode then has a recess on a proximal end thereof for receiving the other end of the cathode support arm.

In one preferred embodiment, third electrode includes a support extending upward through the side wall portion, a probe pin extending upward from the support, the probe pin having a reduced circumference, and a probe which extends from the probe pin. The support typically includes seat therein for receiving the probe pin.

The window may be made of sapphire, may be flat or convex in shape, and may include a transparent member surrounded by a collar which is secured to the side wall portion. Further included may be a shield member extending about the collar and a portion of the side wall. In one embodiment, the side wall portion includes an integral support for the window.

The reflector may be parabolic or elliptical in shape and preferably terminates on the side wall portion at a location spaced from the cathode support and also at a location spaced from the reduced circumference region of the third electrode. Typically, the trigger probe has a pointed distal tip offset from the arc gap.

The probe stabilized arc discharge lamp of this invention may comprise a base portion; a window spaced from the base portion; a side wall interconnecting the base portion with the window such that the side wall, the base portion, and the window define a gas containing chamber; a first electrode disposed vertically in the chamber and extending outwardly through the base portion; a second electrode also disposed vertically in the chamber and extending outwardly through the base portion, the second electrode spaced from the first electrode defining an arc gap between distal ends of the first and second electrodes; a trigger probe extending to or proximate to the arc gap for triggering an arc in the arc gap; and a reflector disposed about the arc gap for directing radiation generated by the arc out the window.

Preferably, the base portion and the side wall are monolithic in construction and define a concave surface surrounding the arc gap. The base portion and the side wall are typically made of ceramic material and the reflector is preferably an integral part of the concave surface.

The second electrode preferably includes a cathode support extending up through the side wall, a cathode support arm extending horizontally from the cathode support inwardly over the arc gap, and a cathode extending vertically downward from the cathode support arm. The cathode support may have a recess on a distal end thereof for receiving one end of the cathode support arm and the cathode then has a recess on a proximal end thereof for receiving the other end of the cathode support arm.

The trigger probe is preferably disposed on one end on a probe support electrode which extends outwardly thought the base portion. The probe support electrode includes a seat on a distal end thereof, the lamp further including a reduced circumference trigger probe support pin supported on one end by the seat in the probe support electrode. The trigger probe extends inwardly and downward from the trigger probe support pin.

The lamp preferably also includes a sparker assembly including a lead disposed in the chamber, an insulative support for the lead attached to the cathode support arm, and an electrical conductor extending to and within the gas fill tube.

A probe stabilized arc discharge lamp according to this invention includes a base portion; a window spaced from the base portion; a side wall interconnecting the base portion with the window, the side wall, the base portion, and the window defining a chamber; a gas in the chamber; a first electrode disposed vertically in the chamber and extending outwardly through the base portion; a second electrode also disposed vertically in the chamber and extending outwardly through the base portion, the second electrode spaced from the first electrode defining an arc gap between the distal ends of the first and second electrodes; a trigger probe extending to or proximate to the arc gap for triggering an arc in the arc gap; and a reflector disposed about the arc gap for directing radiation generated by the arc out the window.

This invention also features a cathode jig for a probe stabilized arc discharge lamp, the cathode jig comprising a multiple piece body having a first section with an internal channel for receiving an anode therein and a second section with a concave cavity on the distal end thereof for receiving the distal end of a cathode; the first section having a circumference sized to coaxially align the cathode with the anode when the first section is disposed over the anode; and the second section having a length sized to correctly distance the distal end of the cathode from the distal end of the anode. In one example, the multiple piece body is divided into two pieces.

This invention also features a trigger probe jig for a probe stabilized arc discharged lamp, the trigger probe jig comprising a multiple piece body having an internal channel for receiving an anode therein and a distal end with a rest defined thereon for receiving and supporting the distal end of the trigger probe, the body having a circumference and a length sized to correctly orient the trigger probe tip with respect to the arc gap between the cathode and the anode.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
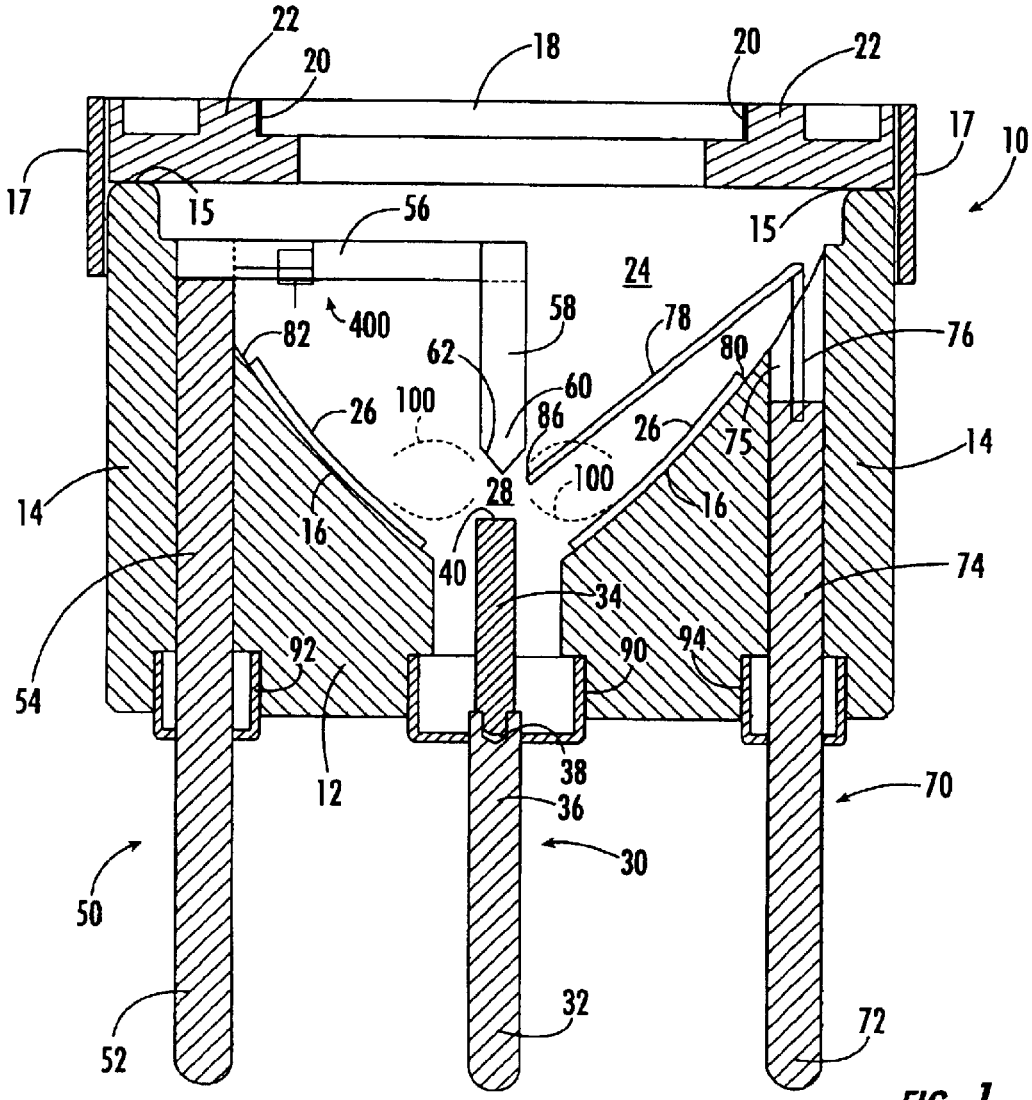
FIG. 1 is a schematic cross sectional view of one embodiment of the probe stabilized arc discharge lamp of the subject invention.

Probe stabilized arc discharge lamp 10, FIG. 1, in one example, preferably includes a housing comprising monolithic base 12 and side wall 14 portions defining concave (parabolic or elliptical) surface 16. Typically, monolithic portions 12 and 14 are made of ceramic because of its electrical insulative properties, ability to withstand high temperatures, moldability, low cost, machineability, and a coefficient of thermal expansion which closely matches a coefficient of thermal expansion of the material of the optical components of lamp 10 including window 18, its metalization 20, and the material of window collar 22. In this embodiment, Kovar window collar 22 is supported on side wall portion 14 as shown at 15 and Kovar shield 17 extends about collar 22 and a portion of side wall 14 as shown for assembly purposes and for electromagnetic interference protection. In other embodiments, the material of base portion 12 and wall portion 14 could be made Kovar, for example.

Window 18, made of, for example, sapphire, glass, magnesium fluoride, and the like (depending on the wavelengths desire to be emitted from lamp 10), is sealed with respect to side wall 14 defining gas (e.g., Xenon) filled chamber 24. Reflector 26, (made of, e.g., aluminum) is disposed on concave surface 16 by sputtering, deposition, or electroplating techniques, for example, and has a focal point preferably defined at arc gap 28.

First electrode 30 is shown centrally disposed in base portion 12 and has distal end 32 which extends outward from base portion 12. First electrode 30 includes vertical anode 34 and anode support 36 with distal anode seat 38. In one example, anode 34 is made of 2% thoriated or pure tungsten and anode support 36 is made of Kovar. Anode 34 typically has a flat distal surface 40.

Second electrode 50 also typically has a distal end 52 which extends outwardly from base portion 12 and includes cathode support 54 which extends vertically up through side wall portion 14, cathode support arm 56 which extends horizontally inward from cathode support 54, and cathode 58 which extends vertically downward from cathode support arm 56 to a location spaced from anode 34 to thus define arc gap 28 at the focal point of reflector 26. In one embodiment, cathode support 54 is made of Kovar, cathode support arm 56 is made of molybdenum, and cathode 58 is made of 805 dense tungsten impregnated with low work function material, for example barium (BA), calcium (CA), and Aluminate ($Al_2O_3$). Cathode 58 preferably has tapered pointed distal end 60 (taper 62, in one example, was 60 degrees).

Third electrode 70 also has distal end 72 which preferably extends outwardly from base portion 12. Thus, all the electrodes, in this embodiment, extend from base portion 12 resulting in a single ended lamp. Third electrode 70 includes trigger probe support 74 extending vertically upward through side wall portion 14, typically opposite of cathode support 54. Reduced diameter trigger probe pin 76 supports trigger probe 78 in a cantilevered manner and probe 78 extends to or proximate to arc gap 28 for triggering an arc in the arc gap between anode 34 and cathode 58.

Reduced diameter trigger probe support pin 76, disposed proximate side wall 14, reduces the breakdown potential between reflector 16 and third electrode 70 and note that reflector 16 preferably terminates on side wall portion 14 at a location 80 spaced 0.060 inches from the edge of probe support pin 76 hole 75 to further reduce the breakdown potential between reflector 16 and third electrode 70. The same is true at location 82: reflector 26 terminates on side wall portion 14 at a location 0.060 inches spaced from the cathode support 54 hole. Trigger probe support 74 is typically made of Kovar, trigger probe support pin 76 is typically made of molybdenum, and trigger probe 78 is typically made of tungsten and has distal pointed tip 86. Pointed tip 86 and the fact that it is preferably positioned offset 0.004 inches from centerline of arc gap 28 prevents sputtering of cathode material from cathode 58 onto probe tip 86. Each electrode 30, 50, and 70 is typically positioned in base portion 12 via cups 90, 92, and 94, respectively, which provide stress relief. Lamp 10 further typically includes sparker assembly 400 attached to cathode support arm 56 providing a source of light and ultraviolet photons which facilitate ionization of the xenon in chamber 24 and in arc gap 28 resulting in a lower trigger breakdown potential and improved pulse-to-pulse discharge stability.

Figure 2:
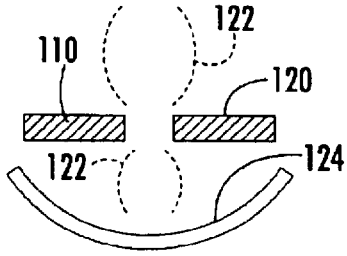
FIG. 2 is a schematic view showing the lambertian distribution of a prior art arc discharge lamp with horizontally disposed electrodes.

In the design of FIG. 1, the lambertian distribution of the radiation from arc gap 28 is as shown by the dotted lines at 100 which, in combination with the arc gap 28 being uniquely locatable at the focal point of reflector 26, results in a higher output (up to 20 times) than prior art pulsed mode arc discharge lamps with horizontally disposed electrodes 110 and 120, FIG. 2 which create a lambersion distribution as shown by the dotted lines at 122. In such a design, reflector 124 must be positioned below electrodes 110 and 120 and occupies an inordinate amount of space in the base portion of the lamp.

In general, those skilled in the art have long desired a pulsed mode arc discharge lamp design with vertically disposed electrodes because such a design exhibits a higher output, longer life, and is more robust. Although continuous mode arc discharge lamps with vertical electrodes are known in the art, they cannot be operated in a pulse mode because, inter alia, of the differences in the internal pressures generated, the lack of a trigger probe in continuously operated arc discharge lamps, the increased cathode and anode sputtering which occurs in a pulse mode, and the criticality of the cathode and anode alignment in pulsed mode arc discharge lamps. Thus, as delineated in the Background section above, the design of a continuous mode arc discharge lamp with vertically disposed electrodes has not translated into a successful pulsed mode arc discharge lamp with vertically disposed electrodes.

Arc discharge lamp 10, FIG. 1, however, is uniquely designed to be operated in a pulsed mode and uniquely has vertically disposed electrodes 30, 50, and 70 and, in particular, vertically disposed anode 34 and cathode 58 made possible, inter alia, by the unique configuration of cathode 58 and anode 54, the presence and design of trigger probe electrode 78, preionization sparker 400, monolithically constructed base 12 and side wall portions 14 with reflector 16 thereon, a novel cathode jig for co-axially aligning and precisely distancing cathode 58 with respect to anode 34, and a novel trigger probe jig for precisely orienting the tip of trigger probe 78 with respect to arc gap 28 as discussed infra.

Lamp 10, FIG. 1, is specifically designed to be operated in a pulse mode and, due to vertically disposed cathode 58 and anode 34, the arc from arc gap 28 can be located at the focal point of reflector 26 resulting in a more efficient lamp with an improved lambertian distribution and a minimum of structure blocking the light path from arc gap 28 out through window 18. Single cathode support arm 56 advantageously blocks less light than the ring strut designs of the prior art. The single ended design shown is also advantageous. Due to probe 78, the light output pulse-to-pulse stability of lamp 10 is approximately one percent compared to lamps without probes having a stability of approximately ten percent. Reduced diameter probe pin 76 and the termination of reflector 26 short of probe pin 76 and cathode support 54 increases the breakdown potential between probe pin 76 and reflector 26. Due to the use of 80% dense tungsten, plus low work function materials for cathode 58, the result is a lower work function cathode with less susceptibility to sputtering and which accommodates high peak currents. Furthermore, the pointed end 86 of probe 78 and its position removed from arc gap 28 (off axis with respect to the longitudinal axis defined by cathode 58 and anode 34) prevents sputtering onto probe tip 86. This design also avoids interference with the arc resulting in a more stable longer life lamp.

Cathode 58 with a distal converging side wall as shown at 60 and 62 is a particularly efficient design: flat cathode tips exhibit good useful lives but produce poor discharge stability while sharply pointed cathode tips produce a better arc but exhibit too short a useful life due to erosion. Anode 34 tip 40, in contrast, is typically made substantially flat for stability and thermal considerations.

Finally, as stated above, the use of a unitary ceramic body for the housing forming base portion 12 and side wall portion 14 with reflector 26 in combination with the features above results in a long life, high output lamp.

Figure 3:
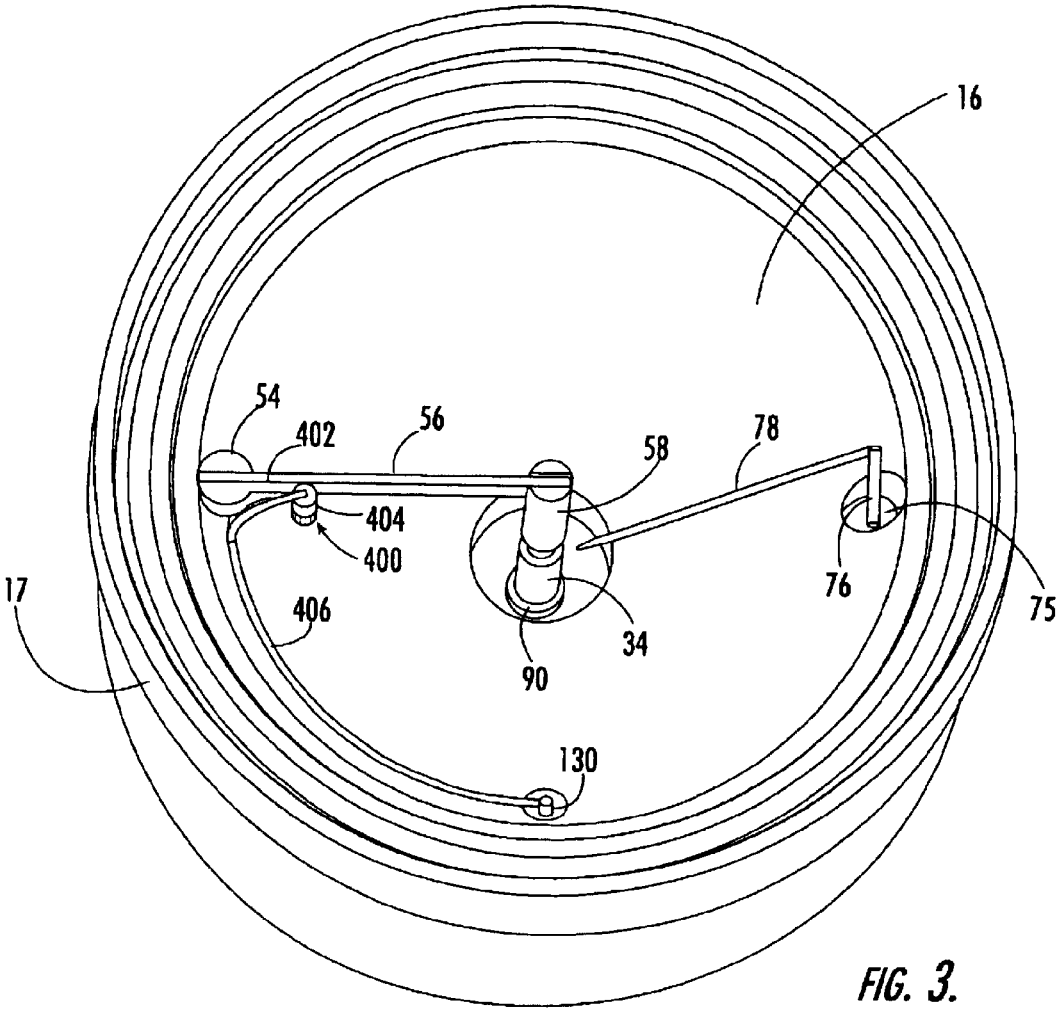
FIG. 3 is a three dimensional schematic top view showing the primary components associated with the probe stabilized arc discharge lamp of the subject invention.

FIG. 3 shows lamp 10, FIG. 1 without the window and reflector. Gas port 130 is also shown which is in communication with a conduit or fill tube, not shown, for filling chamber 24 with Xenon as is known in the art. In the prior art, the fill tube was pinched off after filling the chamber with gas. In this invention, sparker assembly 400 includes lead 402 extending from insulative ceramic support 404 attached to cathode support arm 56 and electrical conductor 406 which extends as shown to fill part 130 and down into the gas fill tube as discussed with reference to FIG. 30 below.

Figure 4:
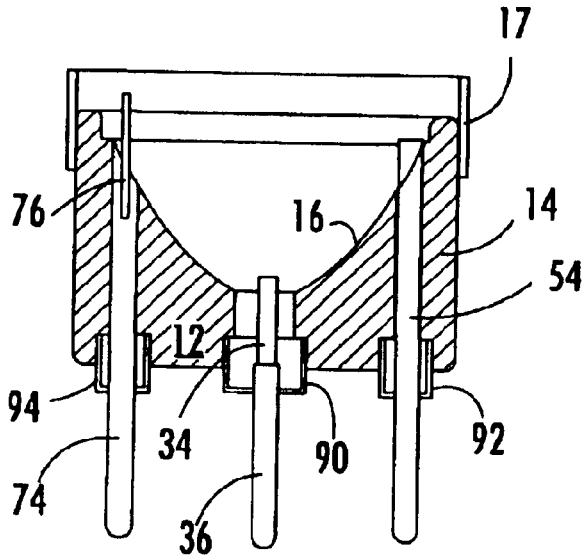
FIG. 4 is a cross sectional view of the housing and electrode portions of the probe stabilized arc discharge lamp of the subject invention.
Figure 6:
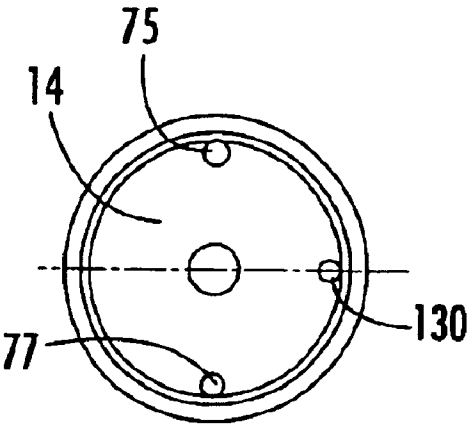
FIG. 6 is a top view of the housing shown in FIG. 5.
Figure 5:
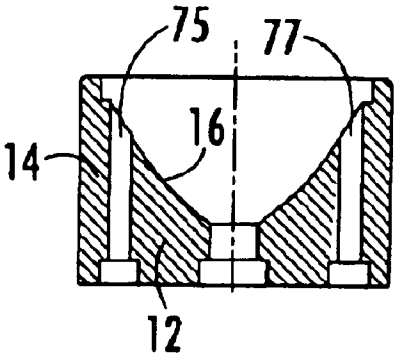
FIG. 5 is a cross sectional view of the housing portion of the probe stabilized arc discharge lamp of this invention.

FIG. 4 shows, in more detail, the electrodes and the ceramic housing before the addition of the trigger probe, the cathode, the anode support arm, the sparker assembly, and the window. In one example, the lamp was approximately one inch in diameter and approximately 0.8 inches tall. FIG. 5 shows the ceramic housing alone with the bores for the electrodes and the electrode cups. FIG. 6 shows probe support 74 orifice 75, orifice 130 for the gas fill tube, and orifice 77 for anode support 54 in side wall 14.

Figure 7:
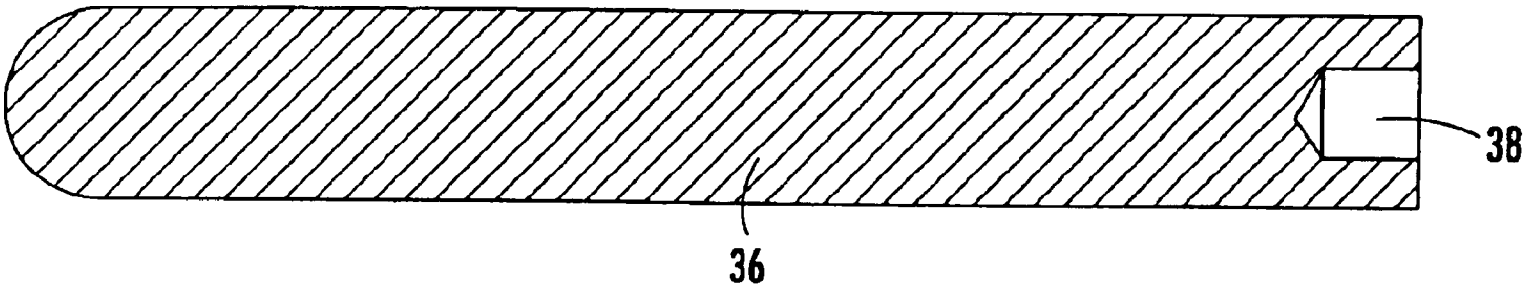
FIG. 7 is a cross sectional view of an anode support component of the arc discharge lamp of this invention.
Figure 8:
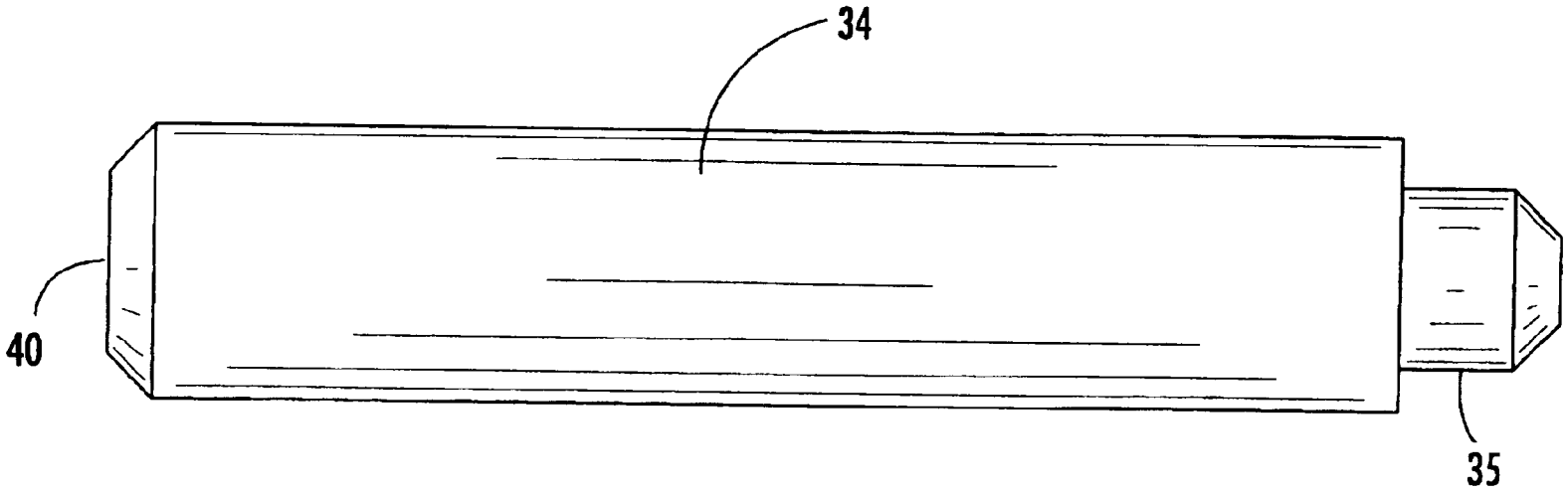
FIG. 8 is a side view of an anode according to one embodiment of this invention.
Figure 9:
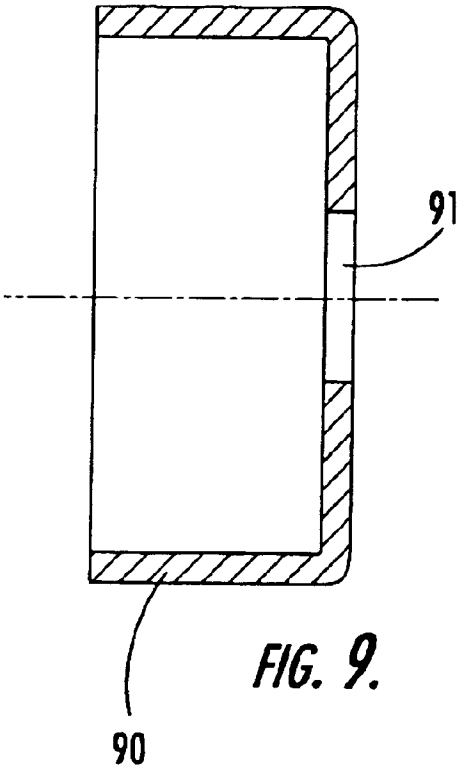
FIG. 9 is a cross sectional view of the anode cup component of the arc discharge lamp of this invention.

FIG. 7 shows anode support 36 which, in one example, was 0.080 inches in diameter and 0.6 inches long. Seat 38 was 0.040 inches in diameter and 0.040 inches deep. Anode 34 is shown in FIG. 8 and, in one example, was 0.325 inches long, and 0.080 inches in diameter. Tapered end 35 is received in anode seat 38, FIG. 7 and, in one example, was 0.040 inches in diameter and 0.035 inches long. Distal end 40, FIG. 8 of anode 34 may have a slight corner chamfer as shown 0.010×45 degrees. Anode cup 90 is shown in FIG. 9 and in one example was 0.271 inches outside diameter with an anode receiving orifice 91 0.0815 inches in diameter. The height of anode cup 90 was 0.195 inches and the wall thickness was 0.0150 inches. Cups 92 and 94, FIG. 1 may be similarly constructed.

Figure 10:
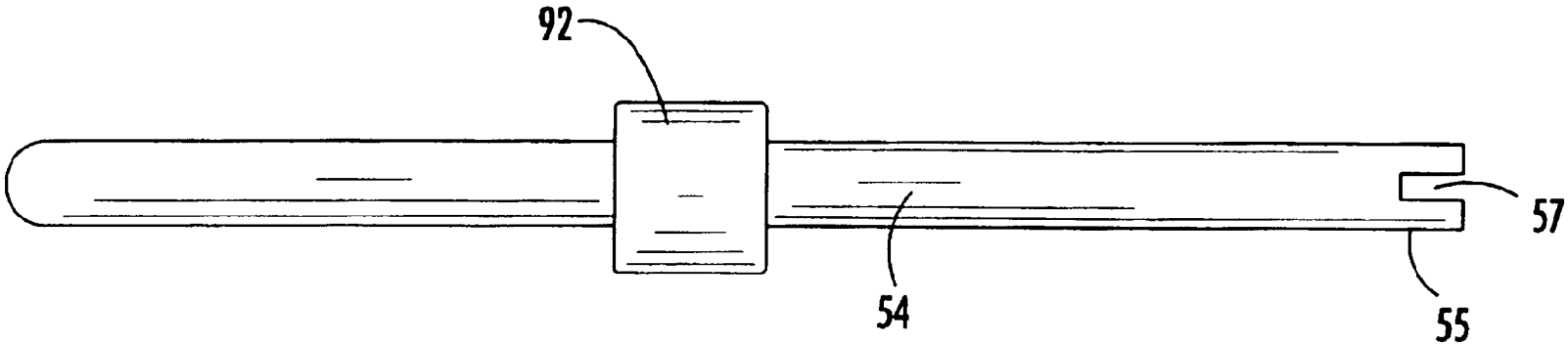
FIG. 10 is a side view of the cathode pin component of the arc discharge lamp according to the preferred embodiment of this invention.
Figure 11:
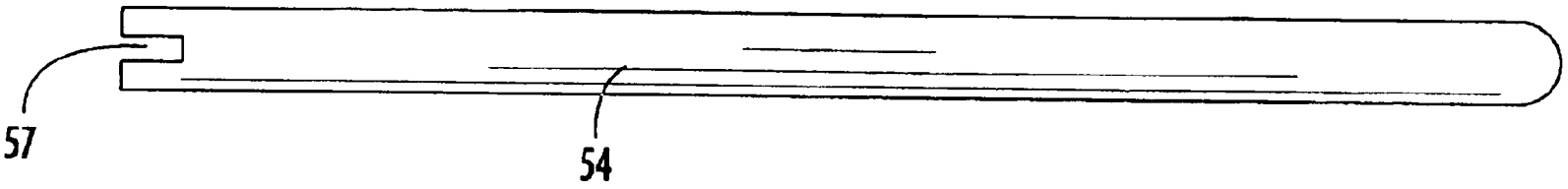
FIG. 11 is another side view of the cathode pin component of the arc discharge lamp of this invention.
Figure 12:
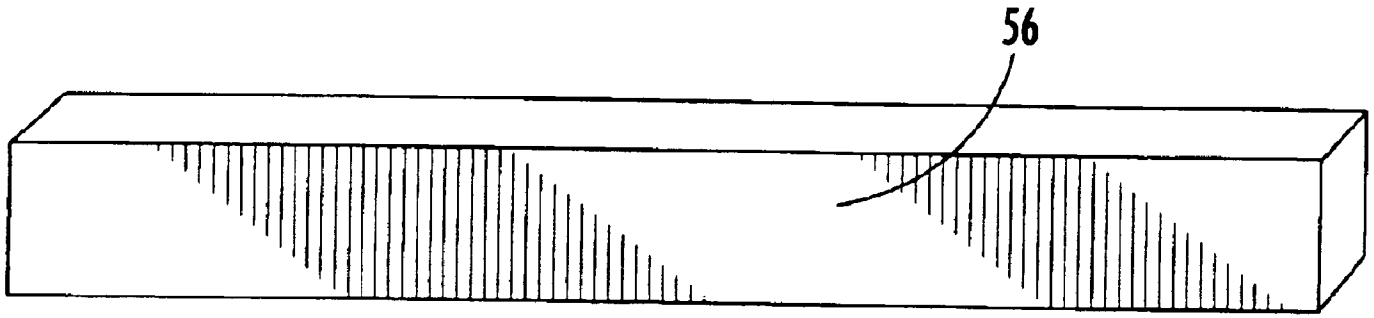
FIG. 12 is a three dimensional schematic view showing the cathode support arm component according to the preferred embodiment of the arc discharge lamp of this invention.
Figure 13:
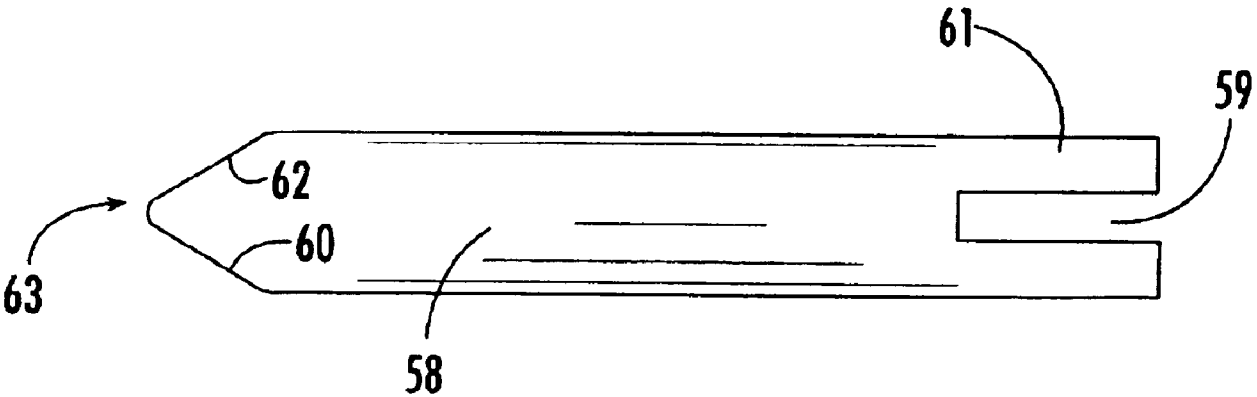
FIG. 13 is a schematic front view of the cathode according to the preferred embodiment of the arc discharge lamp of this invention.

FIG. 10 shows cathode support 54 combined with cathode support cup 92. Cathode support 54 was 1.330 inches long and 0.080 inches in diameter. Distal end 55 includes slot 57 for receiving cathode support arm 56, FIG. 1 therein. Cathode support 54 is also shown in FIG. 11 without the cup. Slot 57 was, in one embodiment, 0.060 inches deep and 0.019 inches wide. Cathode support arm 56, FIG. 12 is typically a lengthy rectangular cross section bar 0.531 inches long, 0.060 inches wide, and 0.015 inches thick. Cathode 58, FIG. 13 then includes slot 59 on proximal end 61 thereof 0.019 inches wide and 0.08 inches deep. Cathode 58 itself is 0.402 inches long and the radius of distal tip 53 is 0.005 inches. In this specific example, the body of cathode 58 was 0.080 inches in diameter.

During assembly, cathode support 54, FIG. 4 is secured in base portion 12. Slot 57, FIG. 10 of cathode support 54, then receives one end of cathode support arm 56 while slot 59, FIG. 13, of cathode 58 then receives the other end of cathode support arm 56. This construction, in combination with the cathode alignment jig of this invention discussed below, greatly facilitates the positioning of the cathode and alignment of the cathode with respect to the anode during assembly of the lamp. Once the alignment is complete, cathode support arm 56 is secured to cathode support 54 by a laser weld and cathode 58 is secured to cathode support arm 56 by brazing.

Figure 14:
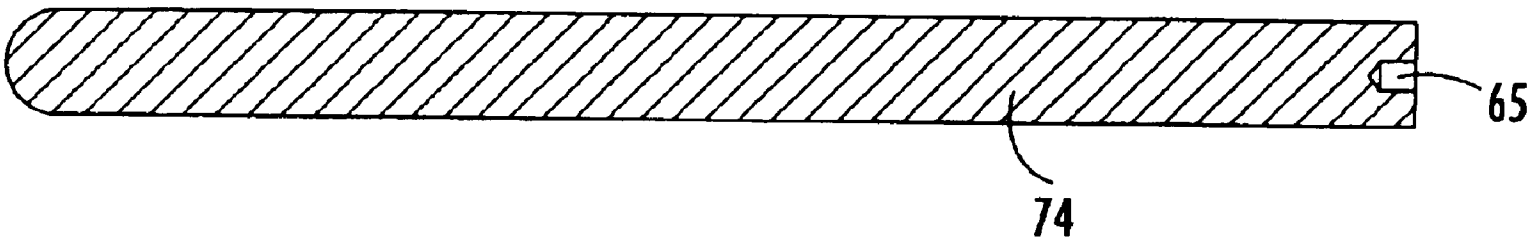
FIG. 14 is a cross sectional view of the probe support according to the preferred embodiment of the arc discharge lamp of this invention.
Figure 15:
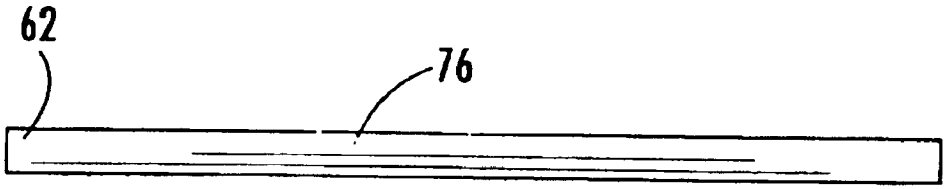
FIG. 15 is a side view of the probe support pin of this invention.
Figure 16:
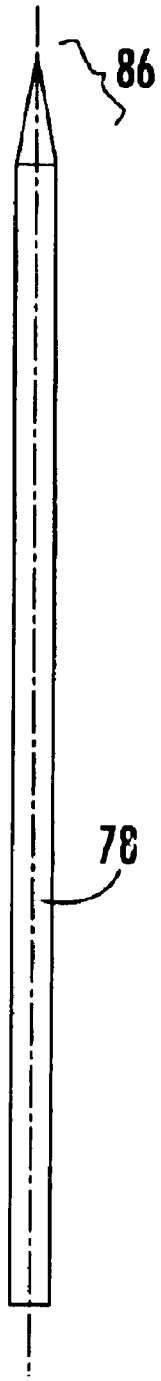
FIG. 16 is a schematic view of the trigger probe of this invention.

Probe support 74, FIG. 14, again in one specific example, was 1.1 inches long, 0.080 inches in diameter and includes probe support pin seat 65 0.030 inches deep and 0.018 inches in diameter. Probe support pin 76, FIG. 15 was a round bar 0.4 inches long and 0.015 inches in diameter. Proximal end 67 is received in seat 65, FIG. 14 of probe support 74. 0.015 inch diameter tungsten probe 78, FIG. 16 was approximately 0.5 inches long and tip portion 86 was 0.042 inches long with a 20° taper and a roundness of 0.005 inches. The proximal end of probe 78 is secured to the distal end of probe support pin 76, FIG. 1 by welding. Sparker assembly 400, FIG. 17 includes lead 402 extending from insulative ceramic support 404 attached to cathode support arm 56.

Figure 18:
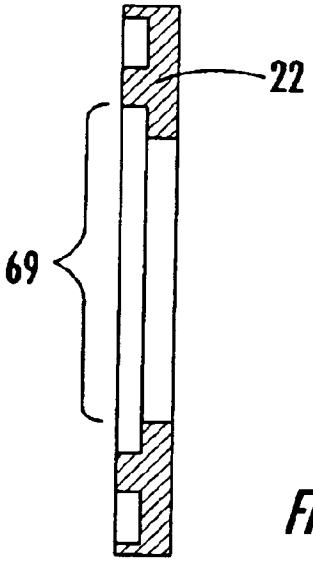
FIGS. 18 and 19 are cross sectional views showing two embodiments of the window support element of the arc discharge lamp of this invention.
Figure 19:
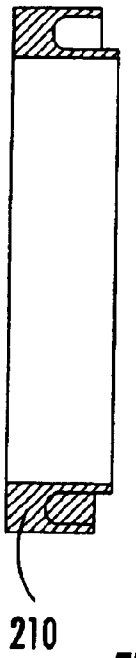

Window support 22, FIG. 18 again in one specific example, has at an outside diameter of 1.239 inches and a window support diameter 69 of 0.780 inches. Window support 22 was 0.125 inches thick and made of Kovar. Opening 23 serves as a heat choice when window support 22 is welded to portion 15 of lamp 10 and shield 17 is welded in place. 1.239 inch diameter Kovar window collar 210, FIG. 19, in another embodiment, may also be used. Window collar 210, in one specific example was 0.255 inches tall, has an outside diameter 1.239 inches and an inside diameter of 1.006 inches.

Figure 20:
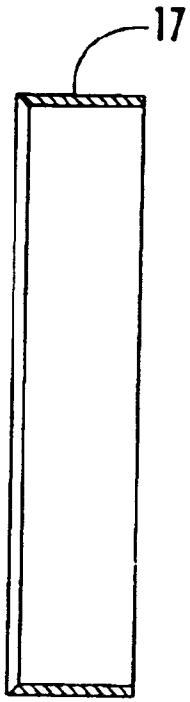
FIG. 20 is a schematic cross sectional view showing the Kovar ring component of the arc discharge lamp of this invention.

Kovar ring 17, FIG. 20 had an outside diameter of 1.300 inches, an inside diameter of 1.250 inches, and was 0.275 inches tall. The specific dimensions of the various components of the arc discharge lamp described above, however, are not limitations of the invention claimed herein.

Figure 17:
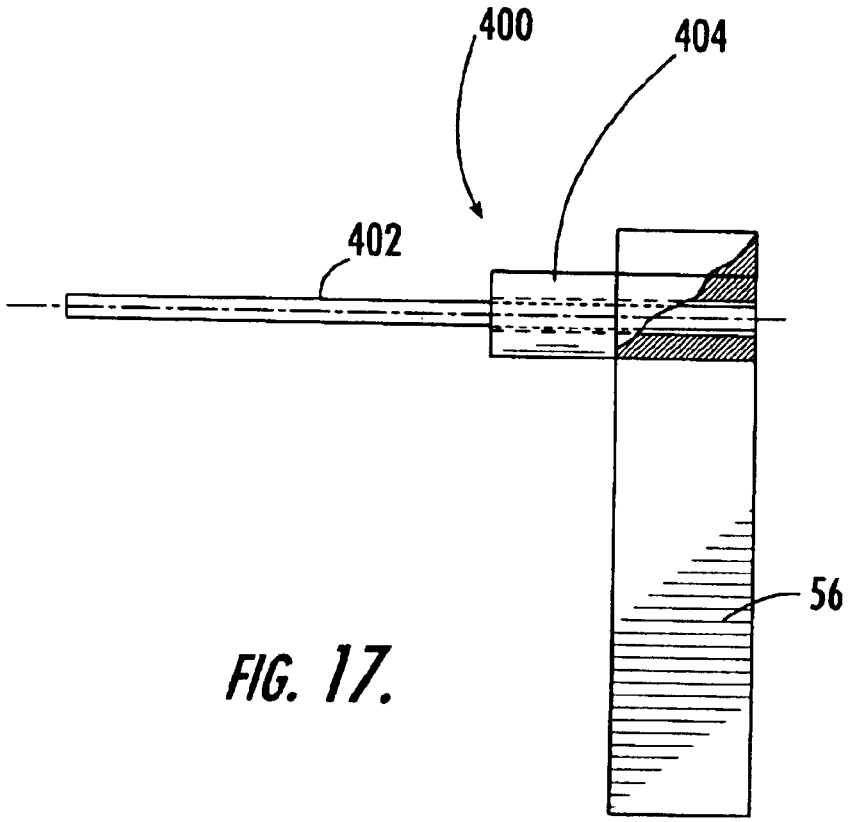
FIG. 17 is a schematic view of the sparker assembly of this invention.
Figure 21:
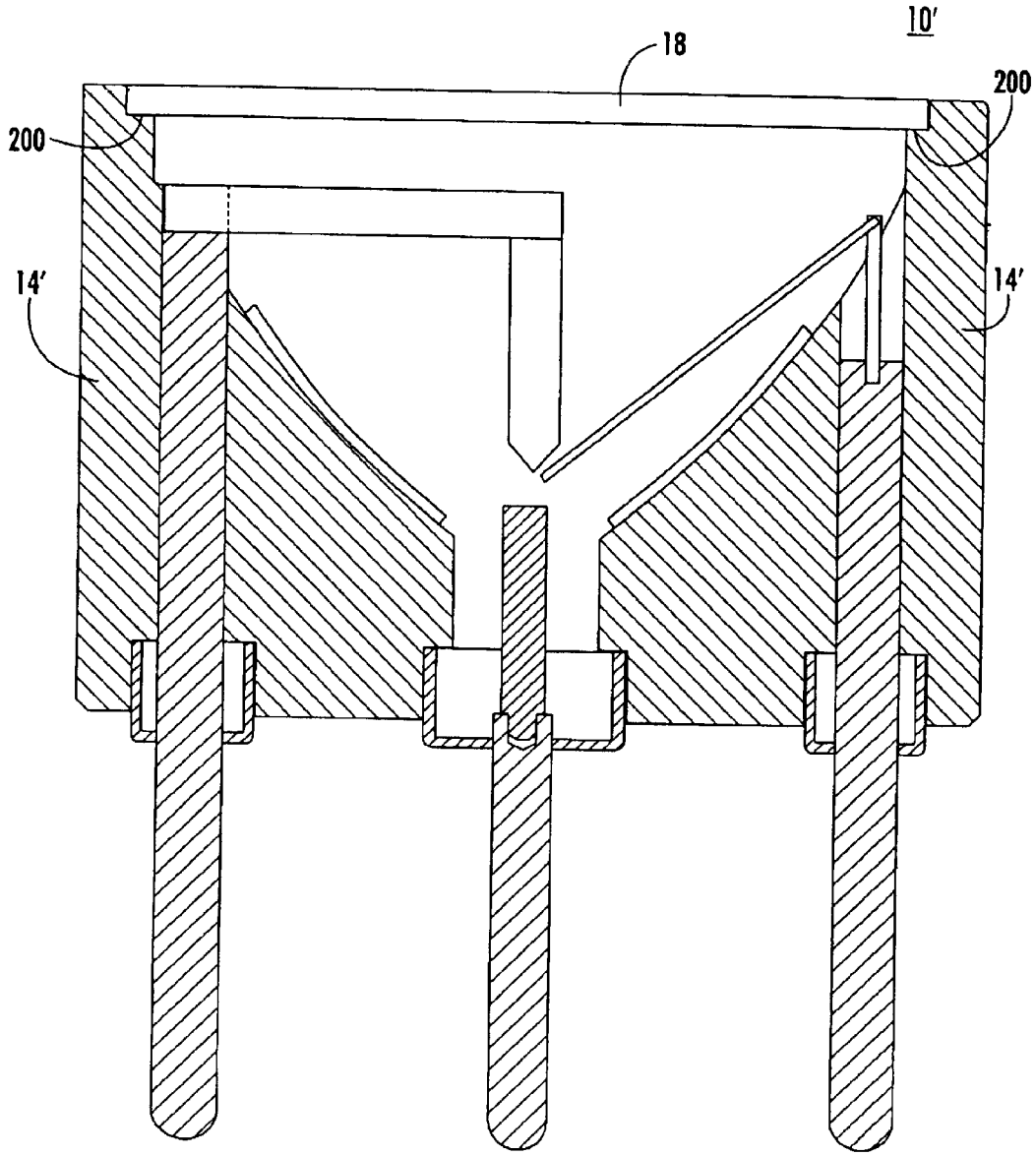
FIG. 21 is a cross sectional view showing another embodiment of a probe stabilized arc discharge lamp in accordance with this invention.

Lamp 10', FIG. 21 advantageously includes side wall 14' with integral support 200 for window 18. Window 18 may include circumferencial edge metalization braized directly to the ceramic material of side wall 14' owing to the single ended design of the lamp. In this design, shield 17, FIG. 1 maybe eliminated. Otherwise, the other components of lamp 10', FIG. 17 are the same as or similar to lamp 10, FIG. 1.

Figure 22:
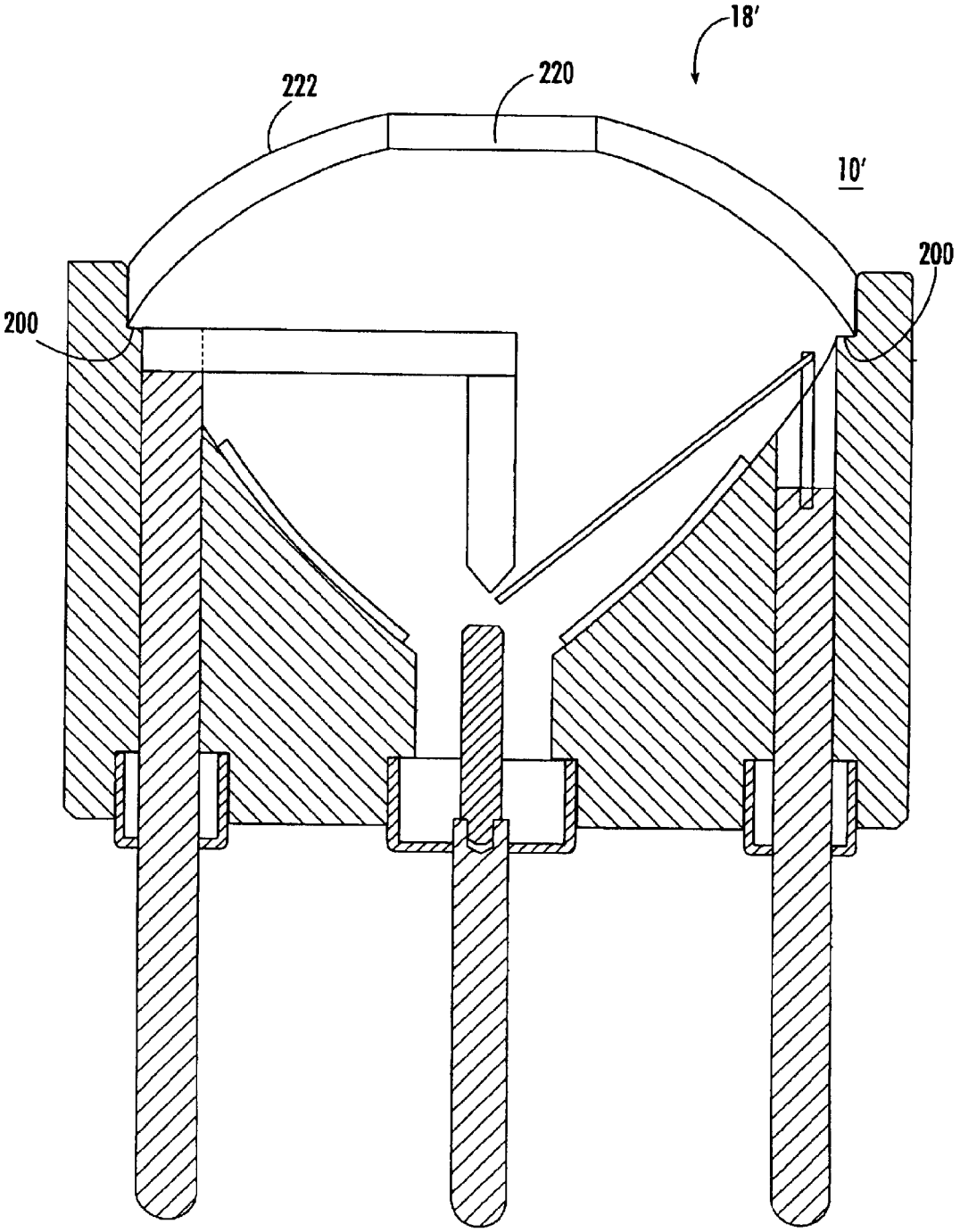
FIG. 22 is a schematic cross sectional view showing another embodiment of a probe stabilized arc discharge lamp in accordance with this invention.

Thus far, the windows disclosed have been flat but this is not a necessary limitation of the subject invention. In the design shown in FIG. 22, window 18' has a convex shape and includes central transparent region 220 supported by support member 222 itself supported by housing supports 200.

FIGS. 23 through 26 show cathode alignment jig 300 which includes stainless steel body 302 made in two pieces 304 and 306 each together defining section 308 with a 0.081–0.083 inch diameter internal channel 301 for receiving anode 34 therein and distal end section 310 with concave 120° 0.045 inch deep cavity 312 which receives the distal end of cathode 58 therein. The 0.190–0.194 inch outer diameter of section 308 is sized to coaxially align cathode 58 with respect to anode 34 and thus its diameter is slightly smaller then the diameter of the orifice in base portion 12 surrounding anode 34. Second section 320 has a length which correctly distances the distal end of cathode 58 from the distal end of anode 34 to define the appropriate arc gap length.

Figure 23:
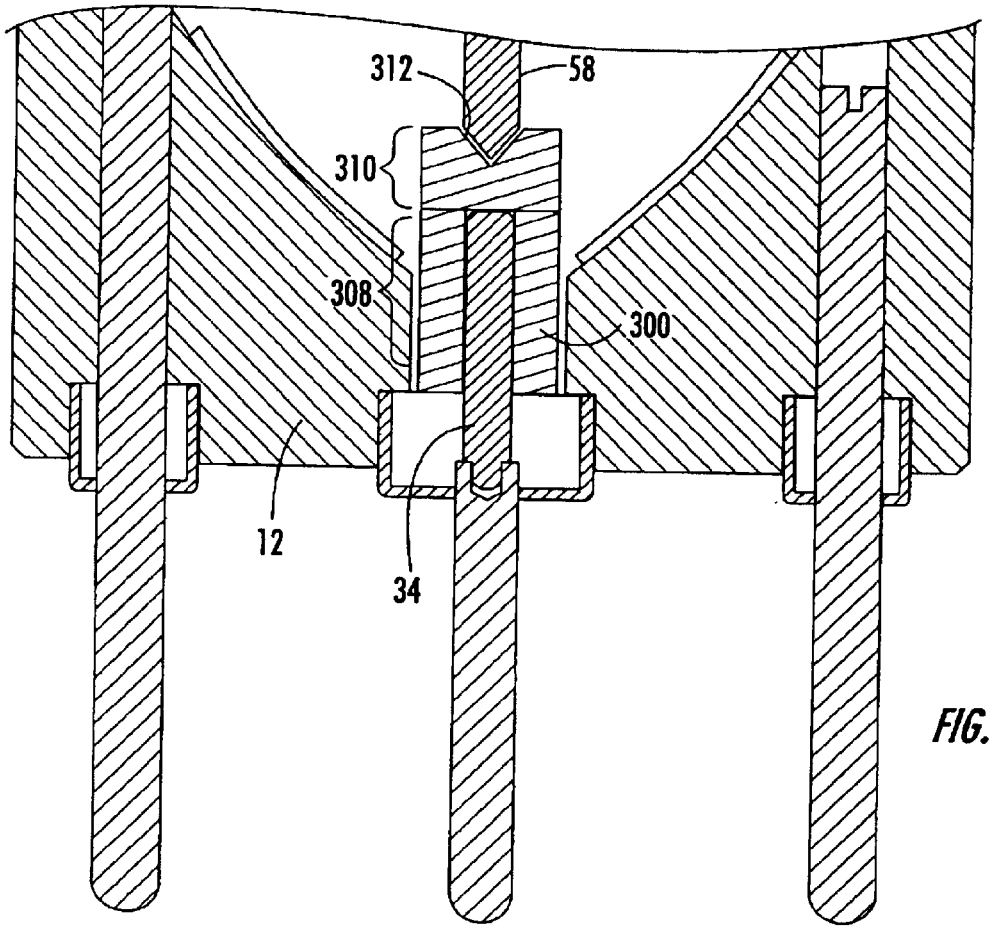
FIG. 23 is a schematic cross sectional view showing the use of the cathode jig of this invention in place over the anode and supporting the cathode during the assembly of a probe stabilized arc discharge lamp.
Figure 24:
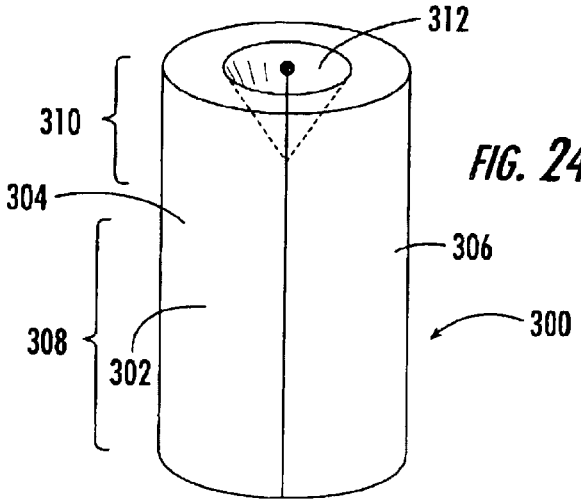
FIG. 24 is a schematic three dimensional view showing the two sections of the cathode jig shown in FIG. 20.
Figure 26:
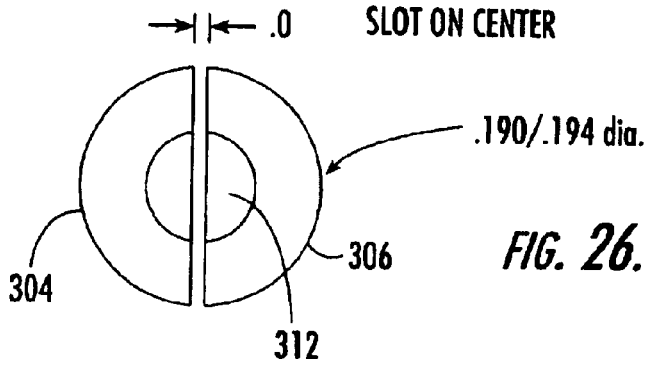
FIG. 26 is a top view of the cathode jig shown in FIG. 25.
Figure 25:
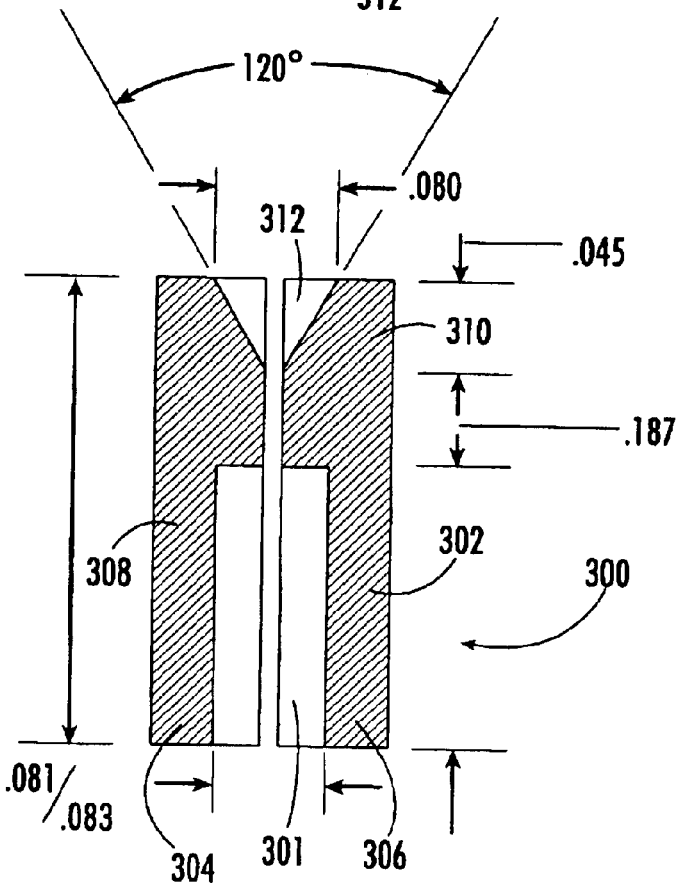
FIG. 25 is a cross-sectional view of the cathode jig shown in FIGS. 23–24.

Preferably, anode 34, FIG. 23 is placed in base portion 12 and both sections 304 and 306 of cathode jig 300 are typically secured together using tape, for example. Jig 300 is then placed over anode 34 as shown. Next, cathode 58 is placed in cavity 312 and supported thereby as cathode support arm 56, FIG. 1 is secured to both cathode 58 and cathode support 54 using the slotted arrangement previously discussed with reference to FIGS. 10–13. Then, the tape about jig 300 is cut and the two pieces 304 and 306 removed from about anode 34 and cathode 58. Thus, the slotted design of FIGS. 10–13 in conjunction with jig 300, FIGS. 23–26 provide for concentric alignment of cathode 58 with respect to anode 34 and the correct, reproducible spacing of the arc gap between the cathode and the anode.

Figure 27:
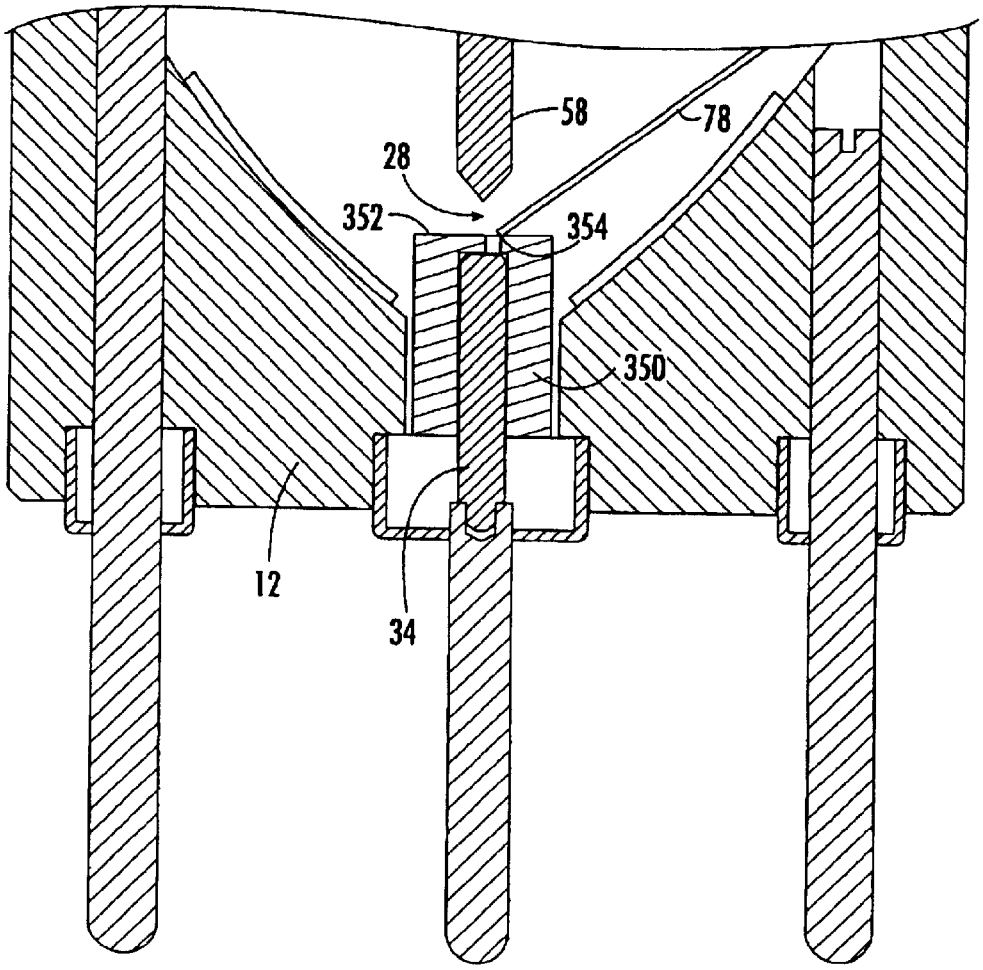
FIG. 27 is a schematic cross sectional view showing the use of the trigger probe jig during the assembly of probe stabilized arc discharge lamps in accordance with this invention.
Figure 29:
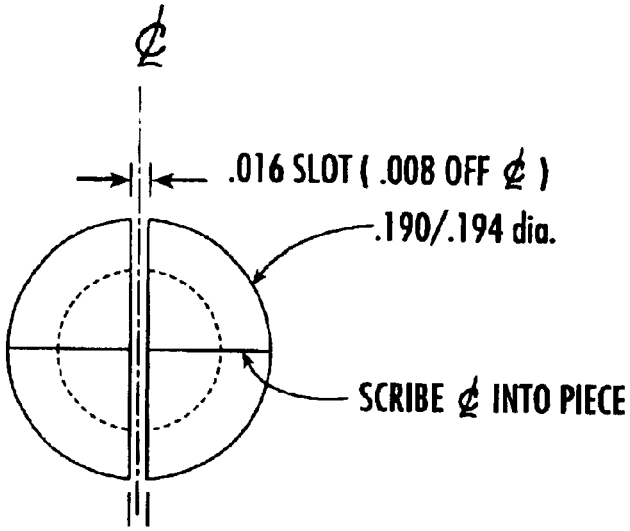
FIG. 29 is a top view of the trigger probe jig shown in FIG. 28.
Figure 28:
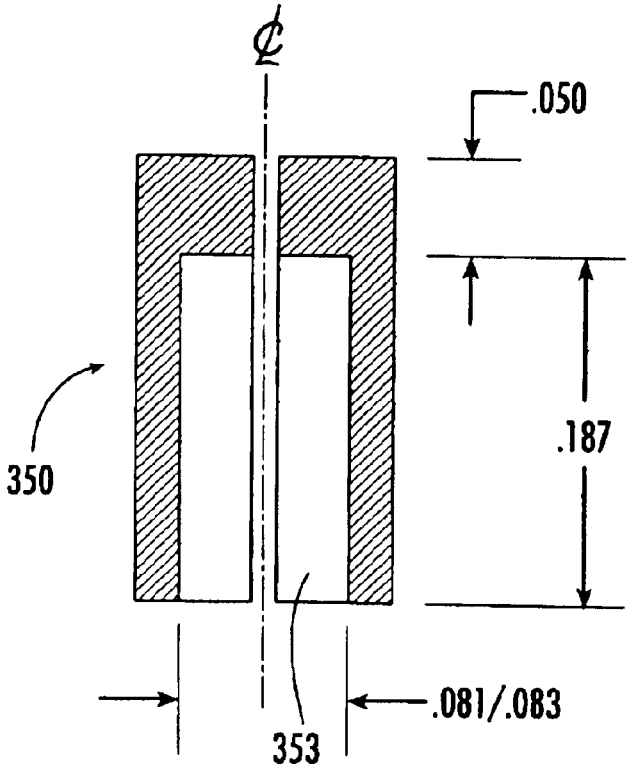
FIG. 28 is a cross sectional view of the trigger probe jig shown in FIG. 27.

Trigger probe jig 350, FIGS. 27–29 is used after the assembly of the cathode and the anode to correctly position the distal tip of trigger probe 78 with respect to arc gap 28. Trigger probe jig 350 also comprises a multi-construction or multi-piece body having internal channel 353 0.081–0.083 inches in diameter and 0.187 inches deep for receiving anode 34 as shown. Distal end 352 of jig 350 includes rest 354 defined by the 0.016 inch slot 0.008 inches off the centerline between the two sections for receiving the distal end of probe 78 as shown. The body of trigger probe jig 350 has a circumference (0.190–0.194 inches in diameter) and a length (0.237 inches) sized to correctly orient the tip of trigger probe 78 with respect to arc gap 28 between cathode 58 and anode 34.

The overall result is a high output, long life arc discharge lamp designed to be operated in a pulsed mode. The vertically disposed electrodes and integrated optical components provide an arc discharge lamp with improved lambertian distribution, and increased stability. The arc discharge lamp of this invention requires less power to operate for a given output, lasts longer, and does not suffer from excess sputtering or breakdown potentials. Typically, the arc discharge lamp is single ended: that is, all the electrodes extend from the base portion of the lamp. The arc discharge lamp of this invention is relatively easy and inexpensive to manufacture and can be repeatedly assembled in an exacting configuration. Cathode jig 300, FIGS. 23–26 co-axially aligns and correctly distances the arc discharge lamp cathode 58 with respect to the anode 34. Trigger probe jig 350, FIGS. 27–29 correctly orients the trigger probe 78 tip with respect to the arc gap 28.

In this invention, the advantages of vertically disposed anode 34 and cathode 58, FIG. 1 are realized in a pulsed mode arc discharge lamp 10 by a uniquely configured anode, cathode, and trigger probe, a monolithically constructed base and side wall 14, an integral reflector 16 constructed directly on the ceramic housing, the use of the novel cathode jig which assists manufacturing personnel in co-axially aligning and precisely distancing cathode 58 with respect to anode 34, and the novel trigger probe jig which assists manufacturing personnel in precisely orienting the tip of probe 78 with respect to arc gap 28.

Figure 30:
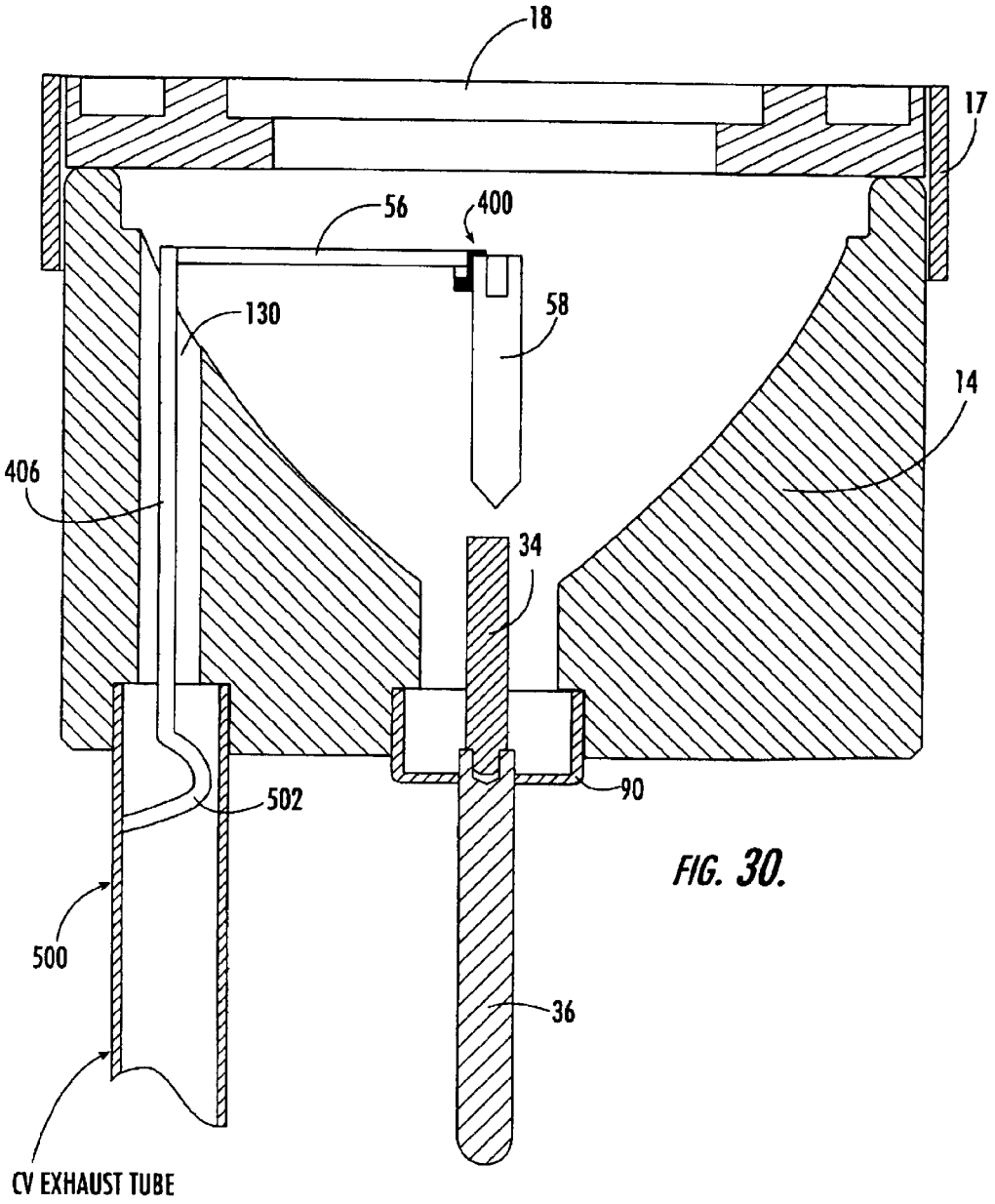
FIG. 30 is a schematic cross sectional view of the arc discharge lamp of the subject invention showing the sparker assembly thereof.

FIG. 30 shows lamp 10 featuring sparker assembly 400 with conductor 406 which extends to and within gas fill tube 500 terminating in spring bend 502. In this way, once exhaust tube 500 is tipped off, it serves as the sparker lead.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. A probe stabilized arc discharge lamp comprising:

a monolithic base portion and side wall portion defining a concave surface;

a window spaced from the base portion and sealed with respect to the side wall portion defining a chamber;

a gas in the chamber;

a reflector disposed on or integral with the concave surface, the reflector having a focal point;

a first electrode centrally disposed in the base portion and having a distal end which extends outwardly from the base portion, the first electrode including an anode support and an anode vertically supported by the anode support;

a second electrode also having a distal end which extends outwardly from the base portion, the second electrode including a cathode support extending vertically upward through the side wall portion, a cathode support arm extending horizontally inward from the cathode support, and a cathode extending vertically downward from the cathode support arm to a location spaced from the anode to define an arc gap at the focal point of the reflector; and a third electrode also having a distal end which extends outwardly from the base portion, the third electrode extending vertically upward through the side wall portion and having a reduced circumference region proximate the side wall portion, the third electrode further including a trigger probe extending from the reduced circumference region to or proximate to the arc gap for triggering an arc in the arc gap between the anode and the electrode.

2. The lamp of claim 1 in which the base portion and the side wall portion are made of a ceramic material.

3. The lamp of claim 1 in which the anode is made of tungsten.

4. The lamp of claim 1 in which the anode support includes a distal seat for receiving the anode.

5. The lamp of claim 1 in which the anode support is made of Kovar.

6. The lamp of claim 1 in which the anode has a flat distal surface with no chamfers.

7. The lamp of claim 1 in which the cathode support is made of Kovar.

8. The lamp of claim 1 in which the cathode support arm is made of molybdenum.

9. The lamp of claim 1 in which the cathode is made of a material including tungsten.

10. The lamp of claim 9 in which the cathode is made of 80% dense tungsten impregnated with barium, calcium, and aluminate.

11. The lamp of claim 1 in which the cathode has a tapered distal end.

12. The lamp of claim 11 in which the cathode has a pointed and tapered distal end.

13. The lamp of claim 12 in which the taper is approximately 60°.

14. The lamp of claim 1 in which the cathode support has a recess on a distal end thereof for receiving one end of the cathode support arm and the cathode has a recess on a proximal end thereof for receiving the other end of the cathode support arm.

15. The lamp of claim 1 in which the third electrode includes a support extending upward through the side wall portion, a probe pin extending upward from the support, the probe pin having a reduced circumference, and a probe which extends from the probe pin.

16. The lamp of claim 15 in which the support includes seat therein for receiving the probe pin.

17. The lamp of claim 1 in which the window is made of sapphire.

18. The lamp of claim 1 in which the window is flat in shape.

19. The lamp of claim 1 in which the window is convex in shape.

20. The lamp of claim 1 in which the window includes a transparent member surrounded by a collar which is secured to the side wall portion.

21. The lamp of claim 20 further including a shield member extending about the collar and a portion of the side wall.

22. The lamp of claim 1 in which the side wall portion includes an integral support for the window.

23. The lamp of claim 1 in which the reflector is parabolic in shape.

24. The lamp of claim 1 in which the reflector is elliptical in shape.

25. The lamp of claim 1 in which the reflector terminates on the side wall portion at a location spaced from the cathode support.

26. The lamp of claim 1 in which the reflector terminates on the side wall portion at a location spaced from the reduced circumference region of the third electrode.

27. The lamp of claim 1 in which the trigger probe has a pointed distal tip.

28. The lamp of claim 1 in which the trigger probe has a distal tip offset from the arc gap.

29. The lamp of claim 1 further including a sparker assembly.

30. The lamp of claim 29 in which the sparker assembly includes a lead disposed in the chamber and an insulative support for the lead attached to the cathode support arm.

31. The lamp of claim 30 further including a gas fill tube, the sparker assembly further including an electrical conductor extending to and within the gas fill tube.

32. A probe stabilized arc discharge lamp comprising:

a base portion and a side wall in monolithic construction defining a concave surface;

a window spaced from the base portion, the side wall interconnecting the base portion with the window, the side wall, the base portion, and the window defining a gas in the chamber;

a gas in the chamber;

a first electrode disposed vertically in the chamber and extending outward through the base portion;

a second electrode also disposed vertically in the chamber and spaced from and extending outward through the base portion, the second electrode spaced from the first electrode defining an arc gap between distal ends of the first and second electrodes, the concave surface surrounding the arc gap;

a trigger probe extending to or proximate to the arc gap for triggering an arc in the arc gap; and a reflector disposed about the arc gap for directing radiation generated by the arc out the window.

33. The lamp of claim 32 in which the trigger probe has a tip offset from the arc gap.

34. The lamp of claim 32 in which the base portion and the side wall are made of ceramic material.

35. The lamp of claim 32 in which the reflector is a part of the concave surface.

36. The lamp of claim 32 in which the first electrode extends outwardly through the base portion and the second electrode also extends outwardly through the base portion.

37. The lamp of claim 32 in which the first electrode is centrally disposed in the base portion and terminates in an anode.

38. The lamp of claim 37 in which the anode is made of tungsten.

39. The lamp of claim 37 in which the first electrode includes an anode support for the anode.

40. The lamp of claim 39 in which the anode support includes a distal seat for receiving the anode.

41. The lamp of claim 39 in which the anode support is made of Kovar.

42. The lamp of claim 37 in which the anode has a flat distal surface with no chamfers.

43. The lamp of claim 32 in which the second electrode includes a cathode support extending up through the side wall, a cathode support arm extending horizontally from the cathode support inward over the arc gap, and a cathode extending vertically downward from the cathode support arm.

44. The lamp of claim 43 in which the cathode support is made of Kovar.

45. The lamp of claim 43 in which the cathode support arm in made of molybdenum.

46. The lamp of claim 43 in which the cathode is made of a material including tungsten.

47. The lamp of claim 46 in which the cathode is made of 80% dense tungsten impregnated with barium, calcium, and aluminate.

48. The lamp of claim 43 in which the cathode has a tapered distal end.

49. The lamp of claim 43 in which the cathode has a pointed distal end.

50. The lamp of claim 43 in which the cathode has a pointed and tapered distal end.

51. The lamp of claim 50 in which the taper is approximately 60°.

52. The lamp of claim 32 in which the trigger probe is disposed on one end on a probe support electrode which extends outwardly thought the base portion.

53. The lamp of claim 52 in which the probe support electrode includes a seat on a distal end thereof, the lamp further including a reduced circumference trigger probe support pin supported on one end by the seat in the probe support electrode, the trigger probe extending inwardly downward from the trigger probe support pin.

54. The lamp of claim 43 in which the cathode support has a recess on a distal end thereof for receiving one end of the cathode support arm and the cathode has a recess on a proximal end thereof for receiving the other end of the cathode support arm.

55. The lamp of claim 32 in which the trigger probe is disposed on one end on probe electrode which extends outwardly through the base portion.

56. The lamp of claim 55 in which the probe electrode includes an upper reduced area probe support pin having a distal end which supports the probe.

57. The lamp of claim 56 in which the probe electrode includes a distal probe support pin seat therein for receiving the probe support pins.

58. The lamp of claim 32 in which the window is made of sapphire.

59. The lamp of claim 32 in which the window is flat in shape.

60. The lamp of claim 32 in which the window is convex in shape.

61. The lamp of claim 32 in which the window includes a transparent member surrounded by collar which is secured to the side wall.

62. The lamp of claim 61 further including a shield member extending about the collar and a portion of the side wall.

63. The lamp of claim 32 in which the side wall includes an integral support for the window.

64. The lamp of claim 32 in which the reflector is parabolic in shape.

65. The lamp of claim 32 in which the reflector is elliptical in shape.

66. The lamp of claim 32 in which the reflector defines a focal point and the arc gap is disposed at the focal point of the reflector.

67. The lamp of claim 43 in which the reflector terminates on the side wall at a location spaced from the cathode support.

68. The lamp of claim 53 in which the reflector terminates on the side wall at a location spaced from the probe support pin.

69. The lamp of claim 32 in which the trigger probe has a pointed tip.

70. The lamp of claim 32 further including a sparker assembly.

71. The lamp of claim 70 in which the sparker assembly includes a lead disposed in the chamber and an insulative support for the lead.

72. The lamp of claim 71 further including a gas fill tube, the sparker assembly further including an electrical conductor extending to and within the gas fill tube.

73. A probe stabilized arc discharge lamp comprising:

a base portion;

a window spaced from the base portion;

a side wall interconnecting the base portion with the window, the side wall, the base portion, and the window defining a gas in the chamber;

a gas in the chamber;

a first electrode disposed vertically in the chamber and extending outward through the base portion;

a second electrode also disposed vertically in the chamber and spaced from and extending outward through the base portion, the second electrode spaced from the first electrode defining an arc gap between distal ends of the first and second electrodes the second electrode including a cathode support extending up through the side wall, a cathode support arm extending horizontally from the cathode support inward over the arc gap, and a cathode extending vertically downward from the cathode support arm;

a trigger probe extending to or proximate to the arc gap for triggering an arc in the arc gap; and a reflector disposed about the arc gap for directing radiation generated by the arc out the window.

74. A probe stabilized arc discharge lamp comprising:

a base portion;

a window spaced from the base portion;

a side wall interconnecting the base portion with the window, the side wall, the base portion, and the window defining a gas in the chamber;

a gas m the chamber;

a first electrode disposed vertically in the chamber and extending outward through the base portion;

a second electrode also disposed vertically in the chamber and spaced from and extending outward through the base portion, the second electrode spaced from the first electrode defining an arc gap between distal ends of the first and second electrodes;

a trigger probe extending to or proximate to the arc gap for triggering an arc in the arc gap, the trigger probe disposed on one end on a probe support electrode which extends outwardly thought the base portion, the probe support electrode including a seat on a distal end thereof, the lamp further including a reduced circumference trigger probe support pin supported on one end by the seat in the probe support electrode, the trigger probe extending inwardly downward from the trigger probe support pin; and a reflector disposed about the arc gap for directing radiation generated by the arc out the window.

75. A probe stabilized arc discharge lamp comprising:

a base portion and a side wall in monolithic construction defining a concave surface;

a window spaced from the base portion, the window, the base portion, and the side wall defining a chamber;

a gas in the chamber;

a first electrode disposed vertically in the chamber;

a second electrode also disposed vertically in the chamber and spaced from the first electrode defining an arc gap between the distal ends of the first and second electrodes;

a trigger probe extending to or proximate to the arc gap for triggering an arc in the arc gap; and a reflector disposed on the concave surface and about the arc gap for directing radiation generated by the arc out the window.

76. A probe stabilized arc discharge lamp comprising:

a monolithic base portion and side wall portion defining a concave surface;

a window spaced from the base portion and sealed with respect to the side wall portion defining a chamber;

a gas in the chamber;

a reflector disposed on or integral with the concave surface, the reflector having a focal point;

an anode support extending through the base portion and an anode vertically supported by the anode support;

a cathode support vertically extending up through the side wall portion, a cathode support arm extending horizontally inward from the cathode support, and a cathode extending vertically downward from the cathode support arm to a location spaced from the anode to define an arc gap at the focal point of the reflector;

a trigger probe support extending vertically upward through the side wall portion and having a reduced circumference region proximate the side wall portion, and a trigger probe extending inwardly and downward from the reduced circumference region to or proximate to the arc gap for triggering an arc in the arc gap between the anode and the electrode; and a sparker assembly with a lead disposed in the chamber.

77. A probe stabilized arc discharge lamp comprising:

a base portion;

a window spaced from the base portion;

a side wall interconnecting the base portion with the window, the side wall, the base portion, and the window defining a gas in the chamber;

a gas in the chamber, a first electrode disposed vertically in the chamber and extending outward through the base portion, the first electrode centrally disposed in the base portion and terminating in an anode;

a second electrode also disposed vertically in the chamber and spaced from and extending outward through the base portion, the second electrode spaced from the first electrode defining an arc gap between distal ends of the first and second electrodes;

a trigger probe extending to or proximate to the arc gap for triggering an arc in the arc gap; and a reflector disposed about the arc gap for directing radiation generated by the arc out the window.

78. The lamp of claim 77 in which the anode is made of tungsten.

79. The lamp of claim 77 in which the first electrode includes an anode support for the anode.

80. The lamp of claim 79 in which the anode support includes a distal seat for receiving the anode.

81. The lamp of claim 79 in which the anode support is made of Kovar.

82. The lamp of claim 77 in which the anode has a flat distal surface with no chamfers.

* * * * *